US008673529B2

(12) United States Patent
Kinoshita et al.

(10) Patent No.: US 8,673,529 B2
(45) Date of Patent: Mar. 18, 2014

(54) MAGNETIC CARRIER FOR ELECTROPHOTOGRAPHIC DEVELOPER AND PROCESS FOR PRODUCING THE SAME, AND TWO-COMPONENT SYSTEM DEVELOPER

(75) Inventors: Kaori Kinoshita, Hiroshima-ken (JP); Shinji Uemoto, Hiroshima-ken (JP); Eiichi Kurita, Hiroshima-ken (JP)

(73) Assignee: Toda Kogyo Corporation, Hiroshima-ken (JP)

( * ) Notice: Subject to any disclaimer, the term of this patent is extended or adjusted under 35 U.S.C. 154(b) by 19 days.

(21) Appl. No.: 13/377,904

(22) PCT Filed: Jun. 15, 2010

(86) PCT No.: PCT/JP2010/060138

§ 371 (c)(1), (2), (4) Date: Jan. 23, 2012

(87) PCT Pub. No.: WO2010/147119

PCT Pub. Date: Dec. 23, 2010

(65) Prior Publication Data

US 2012/0115078 A1 May 10, 2012

(30) Foreign Application Priority Data

Jun. 16, 2009 (JP) ..... 2009-143214

(51) Int. Cl.
*G03G 9/113* (2006.01)

(52) U.S. Cl.
USPC ..... 430/111.31; 430/111.32; 430/111.35; 430/111.4

(58) Field of Classification Search
USPC ..... 430/111.31, 111.32, 111.35, 111.4
See application file for complete search history.

(56) References Cited

U.S. PATENT DOCUMENTS

| | | | |
|---|---|---|---|
| 5,108,862 | A | 4/1992 | Kishimoto et al. |
| 2012/0129087 | A1 | 5/2012 | Iwami et al. |

FOREIGN PATENT DOCUMENTS

| | | |
|---|---|---|
| JP | 3-192268 | 8/1991 |
| JP | 9-311505 | 12/1997 |
| JP | 2008-83098 | 4/2008 |

OTHER PUBLICATIONS

Extended European Search Report in EP 10 789 494.1 dated Aug. 6, 2013.

*Primary Examiner* — Hoa V Le
(74) *Attorney, Agent, or Firm* — Nixon & Vanderhye P.C.

(57) ABSTRACT

The present invention relates to a magnetic carrier for an electrophotographic developer comprising spherical composite particles comprising spherical composite core particles comprising at least ferromagnetic iron oxide fine particles and a cured phenol resin and having an average particle diameter of 1 to 100 μm, and a melamine resin coating layer formed on the respective core particles, wherein a ratio of $R_{100}$ to $R_{300}$ ($R_{100}/R_{300}$) in which $R_{100}$ is an electric resistance value as measured when applying a voltage of 100 V to the magnetic carrier; and $R_{300}$ is an electric resistance value as measured when applying a voltage of 300 V to the magnetic carrier, is controlled to lie within the range of 1 to 50. The magnetic carrier according to the present invention is capable of maintaining an adequate electric resistance value upon development, providing images having an excellent image quality, exhibiting a good durability, obtaining a good reproducibility of uniform solid image portions having a high image density, and keeping high quality images having an excellent gradation for a long period of time.

5 Claims, 2 Drawing Sheets

MAGNETIC CARRIER FOR ELECTROPHOTOGRAPHIC DEVELOPER AND PROCESS FOR PRODUCING THE SAME, AND TWO-COMPONENT SYSTEM DEVELOPER

This application is the U.S. national phase of International Application No. PCT/JP2010/60138 filed 15 Jun. 2010 which designated the U.S. and claims priority to JP 2009-143214 filed 16 Jun. 2009, the entire contents of each of which are hereby incorporated by reference.

TECHNICAL FIELD

The present invention relates to a magnetic carrier for an electrophotographic developer which is capable of maintaining a suitable electric resistance value upon development, exhibiting a good durability, obtaining a good reproducibility of uniform solid images having a high image density, and keeping high-quality images having an excellent gradation for a long period of time, and a process for producing the magnetic carrier, as well as a two-component system developer comprising the magnetic carrier for an electrophotographic developer and a toner.

BACKGROUND ART

As is well known in the art, in electrophotographic methods, there is generally adopted the method in which a photosensitive member formed of a photoconductive material such as selenium, OPC (organic semiconductor), α-Si or the like has been used to form an electrostatic latent image thereon by various means. Then, by using a magnetic brush method or the like, a toner having a polarity reverse to that of the latent image is attached onto the latent image by an electrostatic force in order to develop the latent image.

In the above developing process, there is used a two-component system developer comprising a toner and a carrier. The carrying particles called a magnetic carrier act for imparting an appropriate positive or negative electrical quantity to the toner by frictional electrification, and also act for transferring the toner through a developing sleeve containing magnets therein into a developing zone near the surface of the photosensitive member on which the latent image is formed, by using a magnetic force of the magnets.

The electrophotographic methods have been widely applied to copying machines and printers. In recent years, in the market, there is an increasing demand for high-quality images. In this technical field, with the increase in quality of images, reduction in particle size of the developer and increase in copying speed of these apparatuses are promoted, so that the stress exerted on the developer tends to become much larger. Therefore, a large problem is posed on maintaining characteristics of the developer.

With the market's requirements such as personalization and space saving, reduction in size of the electrophotographic image-forming apparatuses such as copying machines and printers is promoted. Further, with the reduction in size of the apparatuses, reduction in size of respective units used in the apparatuses have also been promoted, so that it is required to maintain good properties of the developer used therein even when using a small-size developing device, i.e., using the developer in a small amount.

In general, in order to reduce power consumption in small size apparatuses, there is a demand for a toner which is capable of being fixed to a sufficient extent even with a low fixing energy, i.e., a so-called low-temperature fixing toner. In the case where the toners can ensure a good fixing property at a low temperature, for example, by using low-molecular weight resins therein, it is possible to achieve saving of energy. However, when subjected to repeated development plural times for a long period of time, the toners tend to be spent on a surface of the carrier during continuous use under high-temperature and high-humidity conditions owing to heat or pressure generated thereupon, whereby the carrier particles tend to be strongly bonded together such that the toner is entangled between the spent portions. As a result, there tends to arise such a phenomenon that the developer suffers from blocking, etc., and variation in frictional charge amount of the developer tends to occur, resulting in variation in image density and occurrence of fogging.

In order to prevent occurrence of spent toner onto the surface of the carrier, there has been conventionally proposed the method in which the surface of the carrier is coated with various resins. For example, it is known that the surface of the respective carrier core particles is coated with a releasing resin such as a fluororesin and a silicone resin. Such a coated carrier hardly suffers from occurrence of spent toner upon the development because the surface thereof is coated with the low-surface energy material. As a result, the carrier has a stable charge amount, and the developer using the carrier exhibits a long service life.

On the other hand, the resin-coated carrier is in the form of an insulating material, and therefore hardly acts as a developing electrode, thereby causing such a phenomenon as referred to as an edge effect in particular at solid image portions. In addition, the developing bias tends to become large, so that there tends to occur deposition of the carrier on non-image portions.

In order to solve the above problem, there has been proposed the method of adjusting an electric resistance value of the coating layer by dispersing a conductive material in the coating layer. However, even when the initial electric resistance value of the carrier is adjusted by the above method, the coating layer tends to be abraded by friction, falling-off, etc., owing to stirring in the developing device during long-term use, so that if the core material is a conductive material having a low dielectric breakdown voltage, there occurs a leak phenomenon owing to exposure of the core material to outside, thereby causing such a problem that the electric resistance value of the carrier is gradually decreased and the carrier is adhered on image-forming regions.

In general, in the case where carbon black as the above conductive material is dispersed in the coating layer, the increase in amount of carbon black added tends to cause decrease in electric resistance value of the carrier. However, it may be difficult to well adjust an electric resistance of a carrier whose electric resistance value lies in a medium range of $10^8$ to $10^{12}$ Ωcm by varying the amount of carbon black added to the coating layer.

Also, the magnetic carrier of a resin-coated type exhibits a high electric resistance value when a low voltage is applied, thereto. However, when applying a high voltage to the magnetic carrier, there tends to occur leakage of electric charges therefrom owing to influence of a core material itself thereof. In particular, when a low-electrical resistance material such as an iron powder and magnetite is used as the core material, the above tendency tends to become more remarkable. Thus, when the electric resistance value of the carrier has a high dependency on voltage, the resulting images tend to be generally deteriorated in gradation.

Hitherto, as the carrier constituting a two-component system developer, there are known an iron powder carrier, a ferrite carrier and a magnetic material-dispersed carrier prepared by dispersing magnetic particles in a binder resin.

The iron powder carrier and ferrite carrier are usually used in the form of resin-coated particles. However, since the iron powder carrier has a true specific gravity as large as 7 to 8 g/cm$^3$, whereas the ferrite carrier has a true specific gravity as large as 4.5 to 5.5 g/cm$^3$. Therefore, a large driving force is required to stir these carriers in the developing device, resulting in significant mechanical damage to the device, occurrence of spent toner as well as deterioration in charging property of the carrier itself, and facilitated damage to the photosensitive member. Further, since the adhesion between the surface of the particles and the coating resin is not good, the coating resin tends to be gradually peeled off during use with time, thereby causing variation in the charging property. As a result, the problems such as formation of defective images and carrier adhesion tend to be caused.

The carriers of a magnetic material-dispersed type comprising spherical composite particles formed of magnetic particles and a phenol resin as described in Japanese Patent Application Laid-Open (KOKAI) No. 2-220068 and Japanese Patent Application Laid-Open (KOKAI) No. 8-6303 have a true specific gravity of 3 to 4 g/cm$^3$ which is smaller than those of the above iron powder and ferrite carrier, so that an energy upon impingement between the toner and carrier tends to be reduced, thereby advantageously avoiding occurrence of spent toner. Further, these carriers are far excellent in adhesion to coating resins as compared to the iron powder carrier or ferrite carrier and, therefore, hardly suffers from the problem that the coating resin is peeled-off therefrom during the use.

However, with the recent wide spread of digital copying machines and laser beam printers using a reversal development method, it has been required that the carrier has not only a high dielectric breakdown voltage owing to application of a high bias voltage thereto in the method, but also provides a developed image having a high image density and a high quality with a good gradation, etc. Therefore, the carrier is required to have a long service life capable of maintaining various properties such as charging characteristics and electric resistance for a long period of time as compared to the conventional carriers.

Further, there has been attempted some methods in which composite particles comprising ferromagnetic iron oxide fine particles and a cured phenol resin are used as a magnetic carrier for an electrophotographic developer. For example, there are known the technique of coating a surface of respective composite core particles comprising ferromagnetic fine particles and a cured phenol resin with a melamine resin to increase an electric resistance value thereof (Patent Document 1); the technique of forming a coating layer comprising a copolymer resin obtained by curing at least one resin selected from a melamine resin, an aniline resin and a urea resin, and a phenol resin, on a surface of respective composite core particles comprising iron oxide particles and a cured phenol resin to control an electric resistance value of a carrier (Patent Document 2); the magnetic carrier comprising carrier core particles comprising ferromagnetic compound particles, non-magnetic inorganic compound particles and a phenol resin and a nitrogen compound-containing or -bonding layer formed on the surface of the respective carrier core particles (Patent Document 3); the carrier comprising carrier core particles comprising magnetic particles and a binder resin, and a first resin coating layer comprising a nitrogen-containing resin and a second resin coating layer comprising conductive particles which layers are formed on the surface of the respective carrier core particles (Patent Document 4); or the like.

PRIOR DOCUMENTS

Patent Documents

Patent Document 1: Japanese Patent Application Laid-Open (KOKAI) No. 3-192268

Patent Document 2: Japanese Patent Application Laid-Open (KOKAI) No. 9-311505

Patent Document 3: Japanese Patent Application Laid-Open (KOKAI) No. 2000-39742

Patent Document 4: Japanese Patent Application Laid-Open (KOKAI) No. 2007-206481

SUMMARY OF THE INVENTION

Problems to be Solved by the Invention

The techniques described in the above Patent Documents 1 to 4 have various problems such as failure of keeping a suitable electric resistance value of the carriers upon development.

Under these circumstances, an object of the present invention is to provide a magnetic carrier used for an electrophotographic developer which can maintain a suitable electric resistance value upon development, and is capable of exhibiting a high durability and a good reproducibility of uniform solid images with a high image density, and can keep high-quality images with an excellent gradation for a long period of time, as well as a process for producing the magnetic carrier.

Means for Solving the Problems

The object or technical task of the present invention can be achieved by the following Inventions.

That is, according to the present invention, there is provided a magnetic carrier for an electrophotographic developer comprising spherical composite particles comprising:

spherical composite core particles which comprises at least ferromagnetic iron oxide fine particles and a cured phenol resin, and which have an average particle diameter of 1 to 100 μm, and a melamine resin coating layer formed on the respective core particles, which magnetic carrier for an electrophotographic developer has a ratio of $R_{100}$ to $R_{300}$ ($R_{100}/R_{300}$) within the range of 1 to 50, where $R_{100}$ is an electric resistance value as measured when applying a voltage of 100 V to the magnetic carrier, and $R_{300}$ is an electric resistance value as measured when applying a voltage of 300 V to the magnetic carrier (Invention 1).

Also, according to the present invention, there is provided the magnetic carrier for an electrophotographic developer as described in the above Invention 1, wherein the electric resistance value as measured when applying a voltage of 100 V to the magnetic carrier is $1.0\times10^6$ Ωcm to $1.0\times10^{16}$ Ωcm (Invention 2).

Also, according to the present invention, there is provided the magnetic carrier for an electrophotographic developer as described in the above Invention 1 or 2, further comprising a coating layer comprising at least one resin selected from the group consisting of a silicone-based resin, a fluororesin, an acrylic resin and a styrene-acrylic resin, on a surface of the respective spherical composite particles (Invention 3).

In addition, according to the present invention, there is provided a two-component system developer comprising the magnetic carrier for an electrophotographic developer as described in any one of the above Inventions 1 to 3 and a toner (Invention 4).

Further, according to the present invention, there is provided a process for producing the magnetic carrier for an electrophotographic developer as described in any one of the above Inventions 1 to 3, comprising the steps of:

reacting at least ferromagnetic iron oxide fine particles, a phenol compound and an aldehyde compound in an aqueous medium in the presence of a basic catalyst to produce spherical composite core particles comprising the ferromagnetic iron oxide fine particles and the cured phenol resin; and then adding an acid aqueous solution having an acid dissociation constant pKa of 3 to 6 as an acid catalyst and a methylol melamine aqueous solution to the aqueous medium comprising the resulting spherical composite core particles to form a coating layer comprising a melamine resin on a surface of the respective spherical composite core particles (Invention 5).

Effect of the Invention

The magnetic carrier according to Invention 1 is capable of maintaining a suitable electric resistance value upon development owing to a low dependency on voltage of an electric resistance value thereof, and therefore can be suitably used as a magnetic carrier for an electrophotographic developer.

The magnetic carrier according to Invention 2 is capable of maintaining a suitable electric resistance value upon development owing to a low dependency on voltage of an electric resistance value thereof and a suitable electric resistance value thereof, and therefore can be suitably used as a magnetic carrier for an electrophotographic developer.

The resin-coated magnetic carrier according to Invention 3 is capable of maintaining a suitable electric resistance value upon development owing to a low dependency on voltage of an electric resistance value thereof and a suitable electric resistance value thereof, and is effectively prevented from suffering from occurrence of spent toner and exhibits an further enhanced durability, and therefore can be suitably used as a magnetic carrier for an electrophotographic developer.

The two-component system developer according to Invention 4 comprises the magnetic carrier which is excellent in durability, and therefore can be suitably used as a developer adaptable for high image quality and high copying speed.

The process for producing a magnetic carrier according to Invention 5 can provide the magnetic carrier for an electrophotographic developer which is capable of maintaining a suitable electric resistance value upon development owing to a low dependency on voltage of an electric resistance value thereof, and therefore can be suitably used as the production process of the magnetic carrier.

PREFERRED EMBODIMENTS FOR CARRYING OUT THE INVENTION

Figure 1:
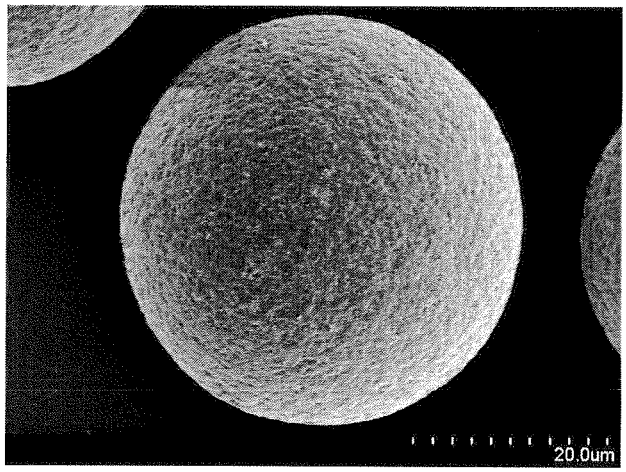
FIG. 1 is an electron micrograph showing a magnetic carrier obtained in Example 1 (magnification: ×2000).

The present invention is described in detail below.

First, the magnetic carrier for an electrophotographic developer (hereinafter referred to merely as a "magnetic carrier") is described.

In the magnetic carrier according to Invention 1, the ratio $R_{100}/R_{300}$ of the electric resistance value $R_{100}$ as measured when applying a voltage of 100 V thereto to the electric resistance value $R_{300}$ as measured when applying a voltage of 300 V thereto is in the range of 1 to 50, preferably 1 to 40 and more preferably 1 to 30. When the ratio $R_{100}/R_{300}$ is more than 50, the voltage dependency of the electric resistance value of the magnetic carrier tends to become high, so that the resulting image tends to be generally undesirably deteriorated in gradation. Meanwhile, in the construction of the present invention, from the technical viewpoints, it may be difficult to control the ratio $R_{100}/R_{300}$ to less than 1.

With respect to an electric resistance value of the magnetic carrier according to Invention 2, the electric resistance value $R_{130}$ of the magnetic carrier as measured when applying a voltage of 100 V thereto is preferably $1.0\times10^{6}$ Ωcm to $1.0\times10^{16}$ Ωcm, more preferably $5.0\times10^{6}$ Ωcm to $1.0\times10^{15}$ Ωcm, and still more preferably $1.0\times10^{7}$ Ωcm to $1.0\times10^{14}$ Ωcm. When the electric resistance value $R_{100}$ of the magnetic carrier is less than $1.0\times10^{6}$ Ωcm, the magnetic carrier tends to be adhered onto an image-forming portion of a photosensitive member owing to injection of electric charges from a developing sleeve thereto, or disturbance of latent images or occurrence of defective images tends to be caused owing to leakage of electric charges on the latent images through the magnetic carrier. On the other hand, when the electric resistance value $R_{100}$ of the magnetic carrier is more than $1.0\times10^{16}$ Ωcm, a solid image portion tends to be hardly reproduced owing to occurrence of edge effects in the solid image.

With respect to an electric resistance value of the resin-coated magnetic carrier according to Invention 3 which is obtained by coating the surface of the respective spherical composite particles with a resin, the electric resistance value of the resin-coated magnetic carrier as measured when applying a voltage of 100 V thereto is preferably $1.0\times10^{7}$ Ωcm to $1.0\times10^{16}$ Ωcm and more preferably $1.0\times10^{8}$ Ωcm to $1.0\times10^{15}$ Ωcm. When the electric resistance value of the resin-coated magnetic carrier is less than $1.0\times10^{7}$ Ωcm, the magnetic carrier tends to be adhered onto an image-forming portion of a photosensitive member owing to injection of electric charges from a developing sleeve thereto, or disturbance of latent images or occurrence of defective images tends to be caused owing to leakage of electric charges on the latent images through the magnetic carrier. On the other hand, when the electric resistance value of the resin-coated magnetic carrier is more than $1.0\times10^{16}$ Ωcm, a solid image portion tends to be hardly reproduced owing to occurrence of edge effects in the solid image.

The magnetic carrier according to the present invention preferably has an average particle diameter of 1 to 100 μm. When the average particle diameter of the magnetic carrier is less than 1 μm, the magnetic carrier tends to suffer from secondary aggregation. When the average particle diameter of the magnetic carrier is more than 100 μm, the magnetic carrier tends to be deteriorated in mechanical strength, thereby failing to attain a clear image. The average particle diameter of the magnetic carrier is more preferably 10 to 70 μm.

The magnetic carrier according to the present invention preferably has a shape factor SF1 of 100 to 120 and a shape factor SF2 of 100 to 120. The shape factor SF1 is more preferably 100 to 110, and the shape factor SF2 is more preferably 100 to 110.

The shape factor SF1 represents a degree of roundness of particles, whereas the shape factor SF2 represents a degree of irregularity on a surface of particles. Therefore, when the particle shape is deviated from a circle (sphere), the shape factor SF1 is increased, whereas when the up-and-down degree of irregularity on the surface of the particles becomes large, the shape factor SF2 is also increased. The respective shape factors are close to 100 as the particle shape approaches a complete round (sphere).

When the shape of the magnetic carrier approaches a sphere and the irregularity on the surface of the magnetic carrier is small, a magnetic brush in the developing zone becomes more uniform, so that the adhesion of the magnetic carrier is effectively prevented. When the shape factor SF1 of the magnetic carrier exceeds 120 or when the shape factor SF2 of the magnetic carrier exceeds 120, it may be difficult to form a uniform resin coating layer thereon, so that the magnetic carrier tends to suffer from non-uniform charge amount and resistance, thereby failing to obtain images having good fineness and clearness. Further, in such a case, there occurs such a tendency that the adhesion strength between the resin coating layer and the core particles is deteriorated, thereby failing to attain a sufficient durability.

The bulk density of the magnetic carrier according to the present invention is preferably not more than 2.5 g/cm$^3$ and more preferably 1.0 to 2.0 g/cm$^3$, and the true specific gravity thereof is preferably 2.5 to 4.5 and more preferably 3.0 to 4.0.

The magnetic carrier according to the present invention preferably has a saturation magnetization value of 20 to 80 Am$^2$/kg (20 to 80 emu/g) and more preferably 40 to 80 Am$^2$/kg (40 to 80 emu/g).

The magnetic carrier according to the present invention preferably has a water content of 0.3 to 1.0% by weight. When the water content of the magnetic carrier is less than 0.3% by weight, no suitable amount of adsorbing water is present on the magnetic carrier, so that a so-called charge-up phenomenon tends to occur, thereby causing deterioration of the resulting images. On the other hand, when the water content of the magnetic carrier is more than 1.0% by weight, the charge amount of the magnetic carrier tends to be unstable depending upon variation of environmental conditions, so that scattering of the toner tends to be caused. The water content of the magnetic carrier is more preferably 0.4 to 0.8% by weight.

The content of the melamine resin in the spherical composite particles is preferably 0.05 to 0.6% by weight, more preferably 0.07 to 0.5% by weight, and still more preferably 0.1 to 0.4% by weight. When the content of the melamine resin is less than 0.05% by weight, the spherical composite core particles tend to be hardly coated with the resin, so that the voltage dependency of the electric resistance value of the obtained spherical composite particles tends to be increased in some cases. On the other hand, when the content of the melamine resin is more than 0.6% by weight, the electric resistance value of the spherical composite particles undesirably tends to become excessively high.

The content of the ferromagnetic iron oxide fine particles in the magnetic carrier according to the present invention is preferably 80 to 99% by weight based on the weight of the magnetic carrier. When the content of the ferromagnetic iron oxide fine particles in the magnetic carrier is less than 80% by weight, the resin component in the magnetic carrier tends to be comparatively increased, so that coarse particles tend to be produced. When the content of the ferromagnetic iron oxide fine particles in the magnetic carrier is more than 99% by weight, the resin component in the magnetic carrier tends to be comparatively reduced, so that the resulting particles may fail to exhibit a sufficient strength. The content of the ferromagnetic iron oxide fine particles in the magnetic carrier is more preferably 85 to 99% by weight.

Next, the process for producing the magnetic carrier for an electrophotographic developer according to the present invention is described.

That is, the magnetic carrier comprising the spherical composite particles according to the present invention may be produced by reacting a phenol compound and an aldehyde compound with each other in an aqueous medium in the co-existence of ferromagnetic iron oxide fine particles in the presence of a basic catalyst to thereby obtain the spherical composite core particles comprising the ferromagnetic iron oxide fine particles and a phenol resin as a cured product, and then adding an acid aqueous solution comprising an acid having an acid dissociation constant pKa of 3 to 6 as an acid catalyst and a methylol melamine aqueous solution to the aqueous medium comprising the spherical composite core particles to form a coating layer formed of a melamine resin on the surface of the respective spherical composite core particles.

Examples of the phenol compound used in the present invention include compounds having a phenolic hydroxyl group, e.g., phenol; alkyl phenols such as m-cresol, p-cresol, p-tert-butyl phenol, o-propyl phenol, resorcinol and bisphenol A; and halogenated phenols obtained by replacing a part or whole of alkyl groups of the above compounds with a chlorine atom or a bromine atom. Among these phenol compounds, from the viewpoint of a good shape property of the resulting particles, most preferred is phenol.

Examples of the aldehyde compound used in the present invention include formaldehyde which may be in the form of either formalin or para-aldehyde, acetaldehyde, furfural, glyoxal, acrolein, crotonaldehyde, salicylaldehyde and glutaraldehyde. Among these aldehyde compounds, most preferred is formaldehyde.

The molar ratio of the aldehyde compound to the phenol compound is preferably 1.0 to 4.0. When the molar ratio of the aldehyde compound to the phenol compound is less than 1.0, it may be difficult to produce the particles as aimed, or since curing of the resin hardly proceeds, there is a tendency that the obtained particles have a low strength. When the molar ratio of the aldehyde compound to the phenol compound is more than 4.0, there is a tendency that the amount of the unreacted aldehyde compound remaining in the aqueous medium after the reaction is increased. The molar ratio of the aldehyde compound to the phenol compound is more preferably 1.2 to 3.0.

As the basic catalyst used in the present invention, there may be mentioned those basic catalysts ordinarily used for production of resol resins. Examples of the basic catalyst include aqueous ammonia, and alkyl amines such as hexamethylenetetramine, dimethyl amine, diethyl triamine and polyethylene imine. Among these basic catalysts, especially preferred is aqueous ammonia. The molar ratio of the basic catalyst to the phenol compound is preferably 0.05 to 1.50. When the molar ratio of the basic catalyst to the phenol compound is less than 0.05, curing of the resin tends to hardly proceed sufficiently, so that it may be difficult to granulate the particles. When the molar ratio of the basic catalyst to the phenol compound is more than 1.50, the structure of the phenol resin tends to be adversely affected, resulting in deteriorated granulation of the particles, so that it may be difficult to obtain particles having a large particle diameter.

Examples of the ferromagnetic iron oxide fine particles used in the present invention include magnetoplumbite-type iron oxide fine particles (such as strontium ferrite particles and barium ferrite particles), and magnetite particles. Among these particles, preferred are magnetite particles.

The ferromagnetic iron oxide fine particles used in the present invention preferably have an average particle diameter of 0.05 to 1.0 μm and more preferably 0.1 to 0.5 μm.

The ferromagnetic iron oxide fine particles used in the present invention may have a particle shape such as a spherical shape, a plate shape, a hexahedral shape, an octahedral shape, a polyhedral shape or the like. Among these particle shapes, preferred is a spherical shape.

In the present invention, the above ferromagnetic iron oxide fine particles may be used in combination with non-magnetic particles such as hematite.

In general, the ferromagnetic iron oxide fine particles comprise a slight amount of impurities derived from the raw materials. Examples of the impurity components include $SiO_2$, Ca, Mn, Na and Mg, and anion components such as sulfate ions and chloride ions. However, these components tend to have an adverse influence on the environmental stability of charge amount. Therefore, the ferromagnetic iron oxide fine particles preferably have a high purity such that the content of impurities therein is not more than 2.0%.

The ferromagnetic iron oxide fine particles used in the present invention all are preferably previously subjected to lipophilic treatment. When using the ferromagnetic iron oxide fine particles subjected to no lipophilic treatment, it may be sometimes difficult to obtain composite particles having a spherical shape.

The lipophilic treatment may be suitably performed by the method of treating the ferromagnetic iron oxide fine particles with a coupling agent such as a silane-based coupling agent or a titanate-based coupling agent, or the method of dispersing the ferromagnetic iron oxide fine particles in an aqueous solvent comprising a surfactant to allow the particles to adsorb the surfactant thereon.

Examples of the silane-based coupling agent include those having a hydrophobic group, an amino group or an epoxy group. Specific examples of the silane-based coupling agent having a hydrophobic group include vinyl trichlorosilane, vinyl triethoxysilane and vinyl-tris(β-methoxy)silane.

Examples of the silane-based coupling agent having an amino group include γ-aminopropyl triethoxysilane, N-β-(aminoethyl)-γ-aminopropyl trimethoxysilane, N-β-(aminoethyl)-γ-aminopropylmethyl dimethoxysilane and N-phenyl-γ-aminopropyl trimethoxysilane.

Examples of the silane-based coupling agent having an epoxy group include γ-glycidoxypropylmethyl diethoxysilane, γ-glycidoxypropyl trimethoxysilane and β-(3,4-epoxycyclohexyl)trimethoxysilane.

Examples of the titanate-based coupling agent include isopropyl triisostearoyl titanate, isopropyl tridecylbenzenesulfonyl titanate and isopropyl tris(dioctylpyrophosphate) titanate.

As the surfactant, there may be used commercially available surfactants. Among these surfactants, those surfactants having a functional group which is capable of directly bonding to a surface of the respective ferromagnetic iron oxide fine particles, or bonding to a hydroxyl group present on the surface of the respective ferromagnetic iron oxide fine particles, and the ionicity of the surfactants is preferably cationic or anionic.

Although the objects of the present invention can be achieved by using any of the above lipophilic treatments, from the viewpoint of good adhesion to phenol resins, the treatments with the silane-based coupling agent having an amino group or an epoxy group are preferred.

The treating amount of the above coupling agent or surfactant is preferably 0.1 to 10% by weight based on the weight of the ferromagnetic iron oxide fine particles to be treated.

The amount of the ferromagnetic iron oxide fine particles which are allowed to coexist when reacting the above phenol compound and aldehyde compound in the presence of a basic catalyst is preferably 75 to 99% by weight based on a total amount of the ferromagnetic iron oxide fine particles, phenol compound and aldehyde compound, and more preferably 78 to 99% by weight from the viewpoint of a high strength of the resulting magnetic carrier.

In the present invention, the reaction for production of the spherical composite core particles may be carried out in the aqueous medium. The concentration of solid components in the aqueous medium is preferably controlled to 30 to 95% by weight and more preferably 60 to 90% by weight.

In the present invention, the reaction for production of the spherical composite core particles may be conducted as follows. That is, the phenol compound, the aldehyde compound, water and the ferromagnetic iron oxide fine particles are fully mixed with each other while stirring, and then the basic catalyst is added to the obtained mixture. The reaction solution to which the basic catalyst is added is heated while stirring to the temperature range of 60 to 95° C., and reacted at that temperature for 30 to 300 min, preferably 60 to 240 min, and the resulting phenol resin is subjected to polycondensation reaction for curing thereof.

In the above reaction, in order to obtain spherical composite core particles having a high sphericity, the reaction temperature is preferably gradually increased. The temperature rise rate is preferably 0.5 to 1.5° C./min and more preferably 0.8 to 1.2° C./min.

Also, in the above reaction, in order to well control the particle size of the obtained particles, the stirring speed of the reaction solution is suitably adjusted. The stirring speed is preferably 100 to 1000 rpm.

The spherical composite core particles used in the present invention are provided on the surface thereof with a coating layer formed of a melamine resin to produce spherical composite particles. The reaction for producing the spherical composite particles may be continuously carried out in the aqueous medium in which the spherical composite core particles have been produced. That is, while maintaining the above reaction solution in a temperature range of 60 to 95° C., an acid aqueous solution comprising an acid having an acid dissociation constant pKa of 3 to 6 as an acid catalyst and a methylol melamine aqueous solution prepared by reacting melamine and the aldehyde compound in the presence of water are added to the reaction solution and react therewith for 30 to 300 min and preferably 60 to 240 min while stirring, so that the resulting cured melamine resin is coated on the surface of the respective spherical composite core particles.

At this time, in order to form a thin uniform coating layer formed of the melamine resin on the surface of the respective spherical composite core particles, the reaction temperature and the treating time are preferably controlled according to the amount of melamine added and the concentration of the acid aqueous solution.

Also, at this time, in order to form a thin uniform coating layer formed of the melamine resin on the surface of the respective spherical composite core particles, the stirring speed is preferably controlled. The stirring speed is preferably 100 to 1000 rpm.

When the cured reaction product is cooled to a temperature of not higher than 40° C., the thin uniform coating layer of the melamine resin is formed on the surface of the respective spherical composite core particles comprising the ferromagnetic iron oxide fine particles and the cured phenol resin to thereby obtain a water dispersion of the spherical composite particles.

The thus obtained water dispersion of the spherical composite particles is subjected to solid-liquid separation by ordinary methods such as filtration and centrifugal separation, and then the obtained solids are washed and dried, thereby obtaining the spherical composite particles as aimed.

In the method of adding the melamine to the aqueous medium comprising the above spherical composite core particles, if the water-insoluble melamine is directly added in a solid state to the aqueous medium, there are obtained the spherical composite particles comprising the spherical composite core particles whose surface is coated with a non-uniform melamine resin coating layer. Therefore, the resulting spherical composite particles tend to undesirably exhibit a high dependency on voltage (Patent Documents 1, 2, 3 and 4).

Therefore, in the method of adding the melamine to the aqueous medium comprising the above spherical composite core particles, it is preferred to add a methylol melamine aqueous solution separately prepared by reacting melamine and an aldehyde compound in water. When the methylolation reaction rapidly proceeds in the aqueous solution, the aqueous solution tends to become whitely turbid owing to polycondensation reaction of methylol melamine, so that it may be difficult to form the thin uniform coating layer of the melamine resin on the surface of the respective spherical composite core particles. Therefore, the methylol melamine aqueous solution is preferably added in the form of a transparent aqueous solution whose polymerization has proceeded to a certain extent, to the aqueous medium comprising the spherical composite core particles.

Since the melamine resin has a positive charging property, the magnetic carrier can be enhanced in a positive charging property by using the melamine resin therein.

Since the melamine resin is capable of forming a hard film, the magnetic carrier can be enhanced in durability by using the melamine resin therein.

The amount of the melamine added based on the spherical composite particles is preferably 0.1 to 5.0% by weight. When the amount of the melamine added is less than 0.1% by weight, it may be difficult to coat the particles therewith to a sufficient extent, and the electric resistance value of the obtained spherical composite particles tend to sometimes have a high dependency on voltage. On the other hand, when the amount of the melamine added is more than 5.0% by weight, the electric resistance value of the obtained particles tends to be excessively high.

The aldehyde compound used for forming the melamine coating layer may be selected from those which are usable in the reaction for production of the above spherical composite core particles.

The molar ratio of the aldehyde compound to melamine in the methylol melamine aqueous solution is preferably 1 to 10, and the concentration of melamine in the methylol melamine aqueous solution is preferably 5 to 50% by weight.

The methylol melamine aqueous solution may be prepared as follows. That is, melamine and the aldehyde compound are added to water to obtain a reaction solution, and the reaction solution is heated while stirring to a temperature of 40 to 80° C. The reaction solution is subjected to methylolation reaction in the above temperature range for 30 to 240 min, preferably for 60 to 180 min to produce the methylol melamine aqueous solution.

The above methylolation reaction of melamine is preferably slowly conducted. In the methylolation reaction, the temperature rise rate is preferably 0.5 to 1.5° C./min, and the stirring speed is preferably 100 to 1000 rpm.

In the present invention, as the acid catalyst, there may be suitably used a weak acid having an acid dissociation constant pKa of 3 to 6. Examples of the weak acid include formic acid, oxalic acid and acetic acid. Among these acids, most preferred is acetic acid. The content of the acid in the aqueous medium used for forming the composite particles is preferably 0.5 to 3% by weight.

The present invention is characterized in that the acid aqueous solution comprising the acid having an acid dissociation constant pKa of 3 to 6 as an acid catalyst and the methylol melamine aqueous solution are added to the aqueous medium comprising the above spherical composite core particles. That is, by adding both the aqueous solutions to the aqueous medium comprising the composite core particles, the reaction and curing speed of methylol melamine become optimum, so that it is possible to form a thin uniform melamine resin coating layer on the surface of the respective spherical composite core particles comprising the ferromagnetic iron oxide fine particles and the cured phenol resin. As a result, the obtained spherical composite particles can exhibit a low dependency on voltage of an electric resistance value thereof and have a suitable electric resistance value, and therefore are capable of maintaining a suitable electric resistance value upon the development.

When using an acid catalyst forming a strong acid having an acid dissociation constant pKa of less than 3 such as, for example, ammonium chloride forming hydrochloric acid, it may be difficult to form the uniform melamine resin coating layer, so that the electric resistance value of the resulting spherical composite particles tends to have an undesirably high dependency on voltage (Patent Documents 1, 2, 3 and 4). In addition, when the acid dissociation constant pKa of the acid catalyst is more than 6, it may be difficult to form the melamine resin coating layer to a sufficient extent.

In the magnetic carrier according to the present invention, the surface of the respective composite particles may be coated with a resin.

The coating resins used in the present invention are not particularly limited. Examples of the coating resins include polyolefin-based resins such as polyethylene and polypropylene; polystyrene; acrylic resins; polyacrylonitrile; polyvinyl-based or polyvinylidene-based resins such as polyvinyl acetate, polyvinyl alcohol, polyvinyl butyral, polyvinyl chloride, polyvinyl carbazole, polyvinyl ether and polyvinyl ketone; vinyl chloride/vinyl acetate copolymers and styrene/acrylic acid copolymers; straight silicone-based resins having an organosiloxane bond and modified products thereof; fluorine-based resins such as polytetrafluoroethylene, polyvinyl fluoride, polyvinylidene fluoride and polychlorotrifluoroethylene; polyesters; polyurethanes; polycarbonates; amino-based resins such as urea/formaldehyde resins; epoxy-based resins; polyamide resins; polyimide resins; polyamide imide resins; fluorine-containing polyamide resins; fluorine-containing polyimide resins; and fluorine-containing polyamide imide resins.

In the magnetic carrier according to Invention 3, the surface of the respective composite particles is preferably coated with at least one resin selected from the group consisting of silicone-based resins, fluorine-based resins, acrylic resins and styrene-acryl-based resins. When coating the surface of the respective composite particles with the silicone-based resins or the fluorine-based resins which have a low surface energy, it is possible to suppress occurrence of spent toner. On the other side, when coated with the acrylic resins or the styrene-acryl-based resins, the effects of enhancing adhesion to the core particles and a charging property of the resulting magnetic carrier can be attained.

Examples of the preferred silicone-based resin include condensation reaction-type silicone resins. Examples of the preferred fluorine-based resins include polyfluorinated acrylate resins, polyfluorinated methacrylate resins, polyfluorinated vinylidene resins, polytetrafluoroethylene resins, polyhexafluoropropylene resins and copolymers obtained by combination of these resins.

Examples of the acrylic resins include copolymers obtained by copolymerizing an alkyl acrylate such as methyl methacrylate, methyl ethacrylate, ethyl methacrylate, butyl methacrylate, lauryl methacrylate, stearyl methacrylate and behenyl methacrylate, a cycloalkyl acrylate such as cyclopentyl methacrylate and cyclohexyl methacrylate or an aromatic acrylate such as phenyl acrylate, with acrylic acid, copolymers obtained by copolymerizing the above acrylates with an epoxy compound such as glycidyl methacrylate, and copolymers obtained by copolymerizing the above acrylates with an alcohol-based compound such as glycerol monomethacrylate and 2-hydroxyethyl methacrylate. In view of a less environmental dependency or the like of the resulting magnetic carrier, among these acrylic resins, preferred are those produced using short-chain alkyl acrylates such as methyl methacrylate and ethyl ethacrylate.

Examples of the styrene-acryl-based resins include copolymers of the above acrylic monomer with a styrene-based monomer. Especially preferred styrene-acryl-based resins are copolymers of styrene with short-chain alkyl methacrylates because the copolymers have a less difference between a charge amount under high-temperature and high-humidity conditions and a charge amount under low-temperature and low-humidity conditions.

The coating amount of the resin on the magnetic carrier of the present invention is preferably 0.1 to 5.0% by weight based on the weight of the composite particles. When the coating amount of the resin is less than 0.1% by weight, it may be difficult to sufficiently coat the particles with the resin, resulting in exposure of the composite particles to outside. When the coating amount of the resin is more than 5.0% by weight, although the resin coat can adhere onto the surface of the respective composite particles, the thus produced composite particles tend to be agglomerated together, so that it may be difficult to well control the particle size of the composite particles. The coating amount of the resin on the magnetic carrier is more preferably 0.5 to 3.0% by weight.

In the present invention, the resin coating layer may also comprise fine particles. Examples of the suitable fine particles include those fine particles capable of imparting a negative charging property to a toner such as fine particles of quaternary ammonium salt-based compounds, triphenylmethane-based compounds, imidazole-based compounds, nigrosine-based dyes, polyamine resins, etc., as well as those fine particles capable of imparting a positive charging property to a toner such as fine particles of dyes comprising metals such as Cr and Co, salicylic acid metal salt compounds, alkyl salicylic acid metal salt compounds, etc. These fine particles may be used alone or in combination of any two or more thereof.

Also, in the present invention, the resin coating layer may also comprise conductive fine particles. It is advantageous to incorporate the conductive fine particles into the resin, because the resulting magnetic carrier can be readily controlled in resistance thereof. As the conductive fine particles, there may be used conventionally known conductive fine particles. Examples of the conductive fine particles include fine particles of carbon blacks such as acetylene black, channel black, furnace black and koechen black; carbides of metals such as Si and Ti; nitrides of metals such as B and Ti; and borates of metals such as Mo and Cr. These conductive fine particles may be used alone or in combination of any two or more thereof. Among these conductive fine particles, preferred are fine particles of carbon blacks.

When coating the surface of the respective core particles with the resin, there may be used the method in which the resin is blown on the spherical composite particles using a known spray dryer, the method in which the spherical composite particles are dry-mixed with the resin using a Henschel mixer, a high-speed mixer, etc., or the method in which the spherical composite particles are impregnated in a resin-containing solvent.

Next, the two-component system developer of the present invention is described.

As the toner used in combination with the magnetic carrier according to the present invention, there may be mentioned known toners. More specifically, there may be used those toners comprising a binder resin and a colorant as main components together with a releasing agent, a fluidizing agent, etc., which may be added to the main components, if required. Also, the toners may be produced by known methods.

<Functions>

The important point of the present invention resides in that the magnetic carrier for an electrophotographic developer comprises spherical composite particles comprising spherical composite core particles comprising at least ferromagnetic iron oxide fine particles and a cured phenol resin and having an average particle diameter of 1 to 100 μm, and a melamine resin coating layer formed on the surface of the respective core particles, wherein a ratio $R_{100}/R_{300}$ of an electric resistance value $R_{100}$ as measured when applying a voltage of 100 V to the magnetic carrier to an electric resistance value $R_{300}$ as measured when applying a voltage of 300 V to the magnetic carrier is controlled to lie within the range of 1 to 50.

In the present invention, by forming a thin uniform coating layer formed of a melamine resin on the surface of the respective spherical composite core particles, it is possible to reduce a voltage dependency of an electric resistance value of the magnetic carrier and allow the magnetic carrier to exhibit a suitable electric resistance value. As a result, the magnetic carrier can maintain a suitable electric resistance value upon development, exhibit a good durability, obtain a good reproducibility of uniform solid images having a high image density, and keep high-quality images having an excellent gradation for a long period of time.

In the resin-coated magnetic carrier according to Invention 3 which is obtained by coating the surface of the respective spherical composite particles with the resin, it is possible to reduce a voltage dependency of an electric resistance value of the spherical composite particles on which a thin uniform melamine resin coating layer is formed, and suitably control the electric resistance value of the spherical composite particles. Therefore, it is possible to readily design an electric resistance property and a charging property of the magnetic carrier obtained by forming a resin coating layer on the surface of the respective spherical composite particles.

The two-component system developer according to Invention 4 is capable of maintaining a high-quality image which is excellent in image density, gradation, etc. In particular, in a high-voltage range where an electric resistance of a core material tends to be considerably influenced, the developer is free from occurrence of brush marks on a solid image portion owing to leakage of electric charges and formation of defective images such as those having deteriorated gradation. Further, it is possible to prevent the magnetic carrier from suffering from deterioration with time owing to abrasion or peeling-off of the coating resin therefrom when used for a long period of time.

EXAMPLES

The present invention is described in more detail by the following typical Examples. However, these Examples are only illustrative and not intended to limit the present invention thereto.

The electric resistance value (volume resistivity) of the particles was expressed by the value as measured using a "High Resistance Meter 4339B" manufactured by Yokogawa Hewlett Packard Co., Ltd.

The average particle diameter of the particles was expressed by the volume-based average value as measured using a laser diffraction particle size distribution meter "LA750" manufactured by Horiba Seisakusho Co., Ltd. Also, the shape of the particles was determined by observing particles using a scanning electron microscope "S-4800" manufactured by Hitachi Ltd.

The shape factors SF1 and SF2 of the magnetic carrier were measured according to the following procedure.

The shape factors SF1 and SF2 as used herein are defined as follows. That is, for example, from a micrograph obtained using a scanning electron microscope "S-4800" manufactured by Hitachi Ltd., images of 100 carrier particles as enlarged images (magnification: ×300 times) were sampled randomly, and these image data were introduced through an interface, for example, into an image analyzer "Luzex AP" manufactured by Nireco Corp., and analyzed therein. The shape factors SF1 and SF2 were defined as the values calculated according to the following formulas.

$$SF1=(\text{Absolute maximum length of particle})^2/(\text{Projected area of particle})\times(\pi/4)\times 100$$

$$SF2=(\text{Peripheral length of particle})^2/(\text{Projected area of particle})\times(1/4\pi)\times 100$$

The shape factor SF1 represents a degree of roundness of particles, whereas the shape factor SF2 represents a degree of irregularity on a surface of particles. Therefore, when the particle shape is deviated from a circle (sphere), the shape factor SF1 is increased, whereas when the up-and-down degree of irregularity on the surface of the particles becomes large, the shape factor SF2 is also increased. The respective shape factors become close to 100 as the particle shape approaches a complete round (sphere).

The bulk density was measured by the method described in JIS K5101.

The true specific gravity was measured using a multivolume density meter "1305 Type" manufactured by Micromeritics/Shimadzu Seisakusho Corp.

The saturation magnetization was expressed by the value measured using a vibration sample-type magnetometer "SM-3S-15" manufactured by Toei Kogyo Co., Ltd., by applying an external magnetic field of 795.8 kA/m (10 kOe) thereto.

The water content was measured by the following Karl Fischer coulometric titration method using a trace water content analyzer "AQ-2100" manufactured by Hiranuma Sangyo Co., Ltd. That is, 1 g of a sample whose moisture content was controlled by allowing the sample to stand under the environmental conditions of 24° C. and 60% RH for 24 hr or longer, was accurately weighed in a glass sampling tube, and then the sampling tube was lidded with an aluminum foil (at this time, an empty sampling tube lidded with the same aluminum foil was prepared in order to calibrate a water content in air).

Under the conditions including a heating temperature of 150° C. and a flow rate of a carrier gas (nitrogen gas) of 100 mL/min, water supplied from a water vaporization device "EV-2010" manufactured by Hiranuma Sangyo Co., Ltd., connected to the trace water content analyzer "AQ-2100", was subjected to titration under the conditions of INTERVAL=30 min and TIMER=1 min. In the measurement, "HYDRANAL AQUALYTE RS" produced by Riedel de Haeen AG was used as a generating solution, and "AQUALYTE CN" produced by Kanto Kagaku Co., Ltd., was used as a counter electrode solution.

The content of melamine based on the composite particles was calculated from an amount of nitrogen determined using a trace total nitrogen analyzer "TN-110" manufactured by Dia Instruments Co., Ltd.

The charge amount of the toner was determined as follows. That is, 95 parts by weight of the magnetic carrier were fully mixed with 5 parts by weight of the toner produced by the following method, and the amount of electric charge generated on the toner was measured using a blow-off charge amount measuring device "TB-200" manufactured by Toshiba Chemical Corp.

Toner Production Example

| | |
|---|---|
| Polyester resin | 100 parts by weight |
| Copper phthalocyanine-based colorant | 5 parts by weight |
| Charge controlling agent (zinc di-tert-butyl salicylate compound) | 3 parts by weight |
| Wax | 9 parts by weight |

The above materials were fully premixed with each other using a Henschel mixer, and the resulting mixture was melted and kneaded in a twin-screw extrusion-type kneader. After being cooled, the kneaded material was pulverized using a hammer mill and then classified to obtain negatively charging blue particles having a weight-average particle diameter of 7.4 μm.

One hundred parts by mass of the above negatively charging blue particles were mixed with 1 part by weight of a hydrophobic silica using a Henschel mixer to obtain a negatively charging cyan toner (a).

[Forced Deterioration Test of Composite Particles]

Fifty grams of the composite particles were charged into a 100-cc glass sampling bottle. After the bottle was plugged, the contents of the bottle were shaken using a paint conditioner manufactured by Red Devil Inc. The charge amounts and electric resistance values of the respective samples before and after being shaken were measured, and further the surface of the respective sample particles was observed using a scanning electron microscope "S-4800" manufactured by Hitachi Ltd., to confirm whether or not any peeling-off or abrasion occurred thereon.

The change in charge amount between before and after the forced deterioration test was expressed by percentage (%) of variation in charge amount of the respective samples between before and after the shaking at normal temperature and normal humidity (24° C. and 60% RH) as shown by the following formula, and the results were evaluated according to the following rankings. The developer was prepared by fully mixing 95 parts by weight of the composite particles of the present invention and 5 parts by weight of the negatively charging cyan toner (a).

$$\text{Rate of change in charge amount}(\%)=(1-Q/Q_{INI})\times 100$$

wherein $Q_{INI}$ is a charge amount before the forced deterioration test; and Q is a charge amount after the forced deterioration test.

A: Rate of change in charge amount between before and after the forced deterioration test was not less than 0% and less than 5%;

B: Rate of change in charge amount between before and after the forced deterioration test was not less than 5% and less than 10%;

C: Rate of change in charge amount between before and after the forced deterioration test was not less than 10% and less than 20%;

D: Rate of change in charge amount between before and after the forced deterioration test was not less than 20% and less than 30%; and E: Rate of change in charge amount between before and after the forced deterioration test was not less than 30%.

The electric resistance value was evaluated by the rate of change (%) in electric resistance of the respective samples between before and after the shaking as measured at normal temperature and normal humidity (24° C. and 60% RH) which is represented by the following formula, and the results were evaluated according to the following rankings.

Rate of change in electric resistance=$\text{Log}(R_{INI}/R)$ wherein $R_{INI}$ is an electric resistance value before the forced deterioration test as measured by applying a voltage of 100 V to the sample; and R is an electric resistance value after the forced deterioration test as measured by applying a voltage of 100 V to the sample.

A: Rate of change in electric resistance value between before and after the forced deterioration test was not less than −0.5 and less than 0;

B: Rate of change in electric resistance value between before and after the forced deterioration test was not less than 0 and less than 0.5;

C: Rate of change in electric resistance value between before and after the forced deterioration test was not less than 0.5 and less than 1;

D: Rate of change in electric resistance value between before and after the forced deterioration test was not less than 1 and less than 1.5; and E: Rate of change in electric resistance value between before and after the forced deterioration test was not less than 1.5.

[Evaluation of Resin-Coated Carrier Based on Image Evaluation]

The developer was prepared by fully mixing 95 parts by weight of the magnetic carrier according to the present invention with 5 parts by weight of the negatively charging cyan toner (a). The thus obtained developer was subjected to the following image evaluation. That is, the developer was subjected to evaluation of printing durability by printing 1,000,000 sheets therewith while varying a bias voltage applied thereto under environmental conditions (NN) of 24° C. and 60% RH and under environmental conditions (HH) of 30° C. and 80% RH. The results were evaluated by the following method.

Meanwhile, the results of the image evaluation were ranked. The specific evaluation method was as follows.

(1) Image Density (Inclusive of Uniformity of Solid Image Portions)

With respect to images of the 1000th sheet (initial) and the 1000000th sheet based on the above evaluation of printing durability, the image density values of solid images thereof were measured using a Macbeth densitometer. The uniformity of solid image portions was visually determined based on a control value of a sample, and the results were evaluated according to the following rankings in which the level C or higher level was regarded as being usable practically.

A: Reproducibility of concentration of original images was good, and uniform solid image portions were obtained without density unevenness;

B: Reproducibility of concentration of original images was good, and no density unevenness occurred;

C: Image density was suitably controlled (practically acceptable level);

D: Although image density was still controlled, non-uniform images were produced and many white lines, etc., occurred; and E: Image density was lowered as a whole and large edge effect occurred, and the image density was considerably deteriorated as compared to that of the original images.

(2) Fogging:

With respect to images of the 1000th sheet (initial) and the 1000000th sheet based on the above evaluation of printing durability, fogging on the images was determined as follow. That is, fogging of the toner on a white background was measured using a colorimeter/color difference meter "CR-300" manufactured by Minolta Corp., in a L*a*b* mode thereof to obtain ΔE. The results were evaluated according to the following rankings in which the level A or B is practically acceptable.

A: ΔE was less than 1.0;

B: ΔE was not less than 1.0 and less than 2.0;

C: ΔE was not less than 2.0 and less than 3.0;

D: ΔE was not less than 3.0.

(3) Gradation:

Images of the 1000th sheet (initial) and the 1000000th sheet based on the above evaluation of printing durability were visually observed to examine the number of gradation patterns whose colors were capable of being distinguished from each other using a gray scale (gradation 0 to 19 test charts) prepared by Eastman Kodak Co. The results were evaluated according to the following rankings in which the level A, B or C is practically acceptable.

A: Gradation 15 (B) or higher;

B: Gradation 13 to 14;

C: Gradation 11 to 12;

D: Gradation 7(M) to 10;

E: Gradation 6 or lower.

[Lipophilic Treatment of Ferromagnetic Iron Oxide Particles: Ferromagnetic Iron Oxide Particles 1]

One thousand grams of spherical magnetite particles (average particle diameter: 0.24 μm) were charged into a 500 mL flask and fully stirred, and then 7.0 g of an epoxy group-containing silane-based coupling agent ("KBM-403" (tradename) produced by Shin-Etsu Chemical Corp.) were added to the flask. The contents of the flask were heated to about 100° C. and intimately mixed and stirred at that temperature for 30 min, thereby obtaining spherical magnetite particles A coated with the silane-based coupling agent.

[Lipophilic Treatment of Ferromagnetic Iron Oxide Particles: Ferromagnetic Iron Oxide Particles 2]

The same procedure as defined above for production of the spherical magnetite particles A was conducted under the same conditions except that one thousand grams of spherical magnetite particles (average particle diameter: 0.31 μm) were charged into a 500 mL flask and fully stirred, and then 5.0 g of an amino group-containing silane-based coupling agent ("KBM-602" (tradename) produced by Shin-Etsu Chemical Corp.) were added to the flask, thereby obtaining spherical magnetite particles B.

Example 1

Production of Spherical Composite Particles

| | |
|---|---|
| Phenol | 12 parts by weight |
| 37% Formalin | 15 parts by weight |
| Spherical magnetite particles A subjected to lipophilic treatment | 100 parts by weight |
| 25% Aqueous ammonia | 7 parts by weight |
| Water | 12 parts by weight |

The above materials were charged into a 1-L four-necked flask, and heated to 85° C. over 60 min while stirring at a stirring speed of 250 rpm, and then the contents of the flask were reacted and cured at the same temperature for 120 min, thereby producing composite core particles comprising the ferromagnetic iron oxide fine particles and the binder resin.

Separately, an acid catalyst comprising 0.3 part by weight of water and 0.5 part by weight of a 99% glacial acetic acid aqueous solution was prepared.

Separately, an aqueous solution comprising 1.5 parts by weight of water, 0.5 part by weight of a melamine powder and 1.3 parts by weight of 37% formalin was heated to about 60° C. while stirring at a stirring speed of 250 rpm over 60 min, and then further stirred for about 40 min, thereby preparing a transparent methylol melamine solution.

Next, while the reaction solution comprising the above produced composite core particles was stirred at a stirring speed of 250 rpm, the above acid catalyst and the above transparent methylol melamine solution were added to the flask maintained at a reaction temperature of 85° C., and the contents of the flask were reacted for 120 min, thereby obtaining spherical composite particles comprising the spherical composite core particles and a melamine resin coating layer formed on the surface of the respective core particles.

Next, the contents of the flask were cooled to 30° C., and then a supernatant liquid was removed therefrom. Further, the resulting precipitate as a lower layer was washed with water and then air-dried. Next, the dried precipitate was dried at a temperature of 150 to 180° C. under reduced pressure (not more than 5 mmHg) to obtain spherical composite particles 1.

As a result, it was confirmed that the resulting spherical composite particles 1 had an average particle diameter of 36 μm; a bulk density of 1.94 g/cm$^2$; a specific gravity of 3.60 g/cm$^3$; a saturation magnetization value of 73.5 Am$^2$/kg; an electric resistance value $R_{100}$ of $1.4\times10^{10}$ Ω·cm as measured when applying a voltage of 100 V thereto; an electric resistance value $R_{300}$ of $2.5\times10^{9}$ Ω·cm as measured when applying a voltage of 300 V thereto; and a ratio of $R_{100}/R_{300}$ of 6.

Figure 2:
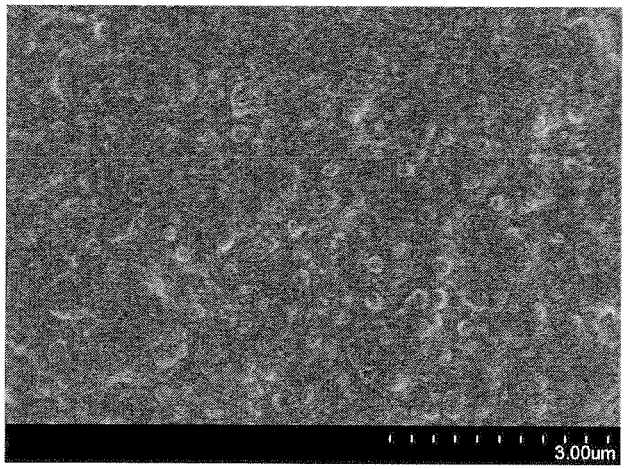
FIG. 2 is an electron micrograph showing the magnetic carrier obtained in Example 1 (magnification: ×15000).

The micrographs of the surface of the thus obtained spherical composite particles 1 are shown in FIG. 1 and FIG. 2 in which FIG. 1 shows a particle structure, and FIG. 2 shows a surface structure. As a result, it was confirmed that the spherical composite particles 1 had a particle shape close to a sphere, and a thin uniform melamine resin coating layer was formed on the surface of the respective particles.

The production conditions of the resulting spherical composite particles 1 are shown in Table 1, and various properties of the spherical composite particles as well as the results of forced deterioration test thereof are shown in Table 2.

As a result, it was confirmed that when subjected to forced deterioration test, the rates of change in charge amount and electric resistance value of the spherical composite particles 1 both were small, and substantially no occurrence of peeling-off and abrasion were observed on the surface of the particles.

Examples 2 to 5 and Comparative Examples 1 to 2

The same procedure as defined in Example 1 was conducted under the same conditions except that the production conditions of the spherical composite particles 1 were changed variously, thereby obtaining spherical composite particles.

The production conditions of the resulting spherical composite particles are shown in Table 1, and various properties of the spherical composite particles and the results of forced deterioration test thereof are shown in Table 2.

As a result, it was confirmed that the spherical composite particles obtained in Examples 2 to 5 had a particle shape close to a sphere, and a thin uniform melamine resin coating layer was formed on the surface of the respective particles.

In addition, it was confirmed that the spherical composite particles obtained in Comparative Example 1 had a particle shape close to a sphere, and a uniform and sufficient melamine resin coating layer was formed on the surface of the respective particles.

Further, it was confirmed that the spherical composite particles obtained in Comparative Example 2 had a particle shape close to a sphere, but a non-uniform melamine resin coating layer to which the underlying ferromagnetic iron oxide particles were exposed was formed on the surface of the respective particles.

Furthermore, it was confirmed that when subjected to forced deterioration test, the rates of change in charge amount and electric resistance value of the spherical composite particles obtained in Examples 2 to 5 and Comparative Example 1 were small, and substantially no occurrence of peeling-off and abrasion were observed on the surface of the particles. On the other hand, it was confirmed that when subjected to forced deterioration test, the rates of change in charge amount and electric resistance value of the spherical composite particles obtained in Comparative Example 2 were large, and occurrence of peeling-off and abrasion were observed on the surface of the particles.

Comparative Example 3

A 1-L four-necked flask was charged with 12 parts by weight of phenol, 16 parts by weight of 37% formalin, 100 parts by weight of the spherical magnetite particles A subjected to lipophilic treatment, 5 parts by weight of 25% aqueous ammonia and 19 parts by weight of water, and the contents of the flask were heated to 85° C. over 60 min while stirring at a stirring speed of 250 rpm. Then, the contents of the flask were reacted and cured at the same temperature for 120 min, thereby producing spherical composite particles comprising the ferromagnetic iron oxide fine particles and the binder resin.

Next, the contents of the flask were cooled to 30° C., and then a supernatant liquid was removed therefrom. Further, the resulting precipitate as a lower layer was washed with water and then air-dried. Next, the dried precipitate was dried at a temperature of 150 to 180° C. under reduced pressure (not more than 5 mmHg) to obtain spherical composite particles.

As a result, it was confirmed that the resulting spherical composite particles had an average particle diameter of 48 μm; a bulk density of 1.91 g/cm$^3$; a specific gravity of 3.58 g/cm$^3$; and a saturation magnetization value of 73.7 Am$^2$/kg. Further, it was confirmed that the electric resistance value $R_{100}$ of the spherical composite particles as measured when applying a voltage of 100 V thereto was $3.0\times10^8$ Ω·cm, but the electric resistance value $R_{300}$ of the spherical composite particles as measured when applying a voltage of 300 V thereto was excessively low and therefore not measurable.

Figure 3:
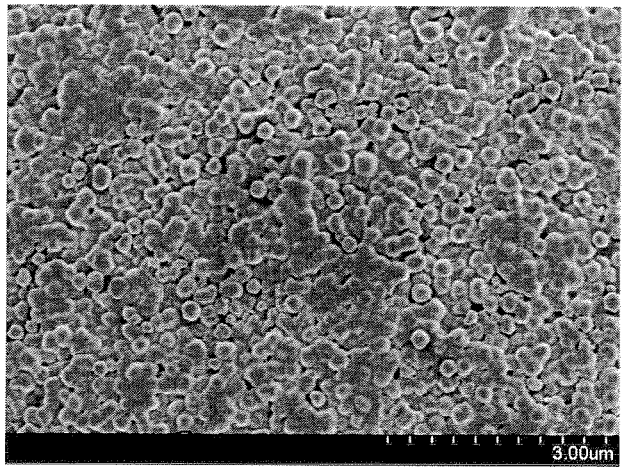
FIG. 3 is an electron micrograph showing a magnetic carrier obtained in Comparative Example 3 (magnification: ×15000).

The micrograph of the surface of the thus obtained spherical composite particles is shown in FIG. 3. As a result, it was confirmed that the spherical composite particles had a particle shape close to a sphere, but the underlying spherical ferromagnetic iron oxide fine particles were exposed on the surface of the spherical composite particles.

Various properties of the obtained spherical composite particles as well as the results of forced deterioration test thereof are shown in Table 2.

Thus, it was confirmed that when subjected to forced deterioration test, the rates of change in charge amount and electric resistance value of the spherical composite particles obtained in Comparative Example 3 were large, and occurrence of peeling-off and abrasion were observed on the surface of the particles.

Comparative Example 4

A 1-L four-necked flask was charged with 0.5 part by weight of a melamine powder, 1.3 parts by weight of 37% formalin, 100 parts by weight of the spherical composite particles obtained in Comparative Example 3, 50 parts by weight of water and 0.6 part by weight of ammonium chloride, and the contents of the flask were heated to 85° C. over 60 min while stirring at a stirring speed of 250 rpm. Then, the contents of the flask were reacted and cured at the same temperature for 120 min, thereby producing spherical composite particles provided on the surface thereof with a melamine resin coating layer.

Next, the contents of the flask were cooled to 30° C., and then a supernatant liquid was removed therefrom. Further, the resulting precipitate as a lower layer was washed with water and then air-dried. Next, the dried precipitate was dried at a temperature of 150 to 180° C. under reduced pressure (not more than 5 mmHg) to obtain spherical composite particles.

As a result, it was confirmed that the resulting spherical composite particles had an average particle diameter of 47 μm; a bulk density of 1.91 g/cm$^3$; a specific gravity of 3.55 g/cm$^3$; a saturation magnetization value of 73.5 Am$^2$/kg; an electric resistance value $R_{100}$ of $7.1\times10^{12}$ Ω·cm as measured when applying a voltage of 100 V thereto; an electric resistance value $R_{300}$ of $5.5\times10^{10}$ Ω·cm as measured when applying a voltage of 300 V thereto; and a ratio of $R_{100}/R_{300}$ of 130.

Figure 4:
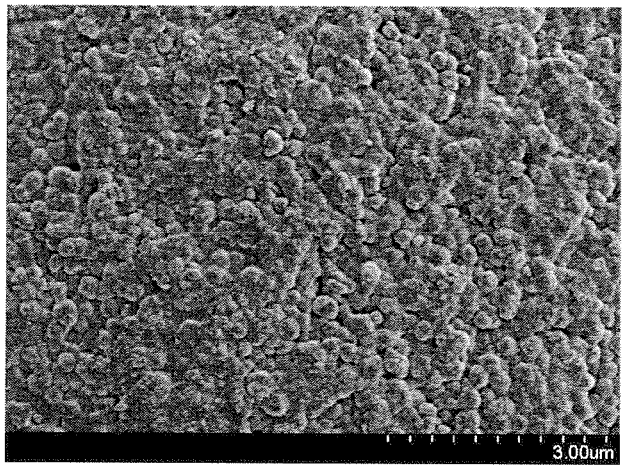
FIG. 4 is an electron micrograph showing a magnetic carrier obtained in Comparative Example 4 (magnification: ×15000).

The micrograph of the surface of the thus obtained spherical composite particles is shown in FIG. 4. As a result, it was confirmed that the spherical composite particles had a particle shape close to a sphere, but a non-uniform melamine resin coating layer to which the underlying ferromagnetic iron oxide fine particles were exposed was formed on the surface of the respective spherical composite particles.

Various properties of the obtained spherical composite particles as well as the results of forced deterioration test thereof are shown in Table 2.

Thus, it was confirmed that when subjected to forced deterioration test, the rates of change in charge amount and electric resistance value of the spherical composite particles obtained in Comparative Example 4 were large, and occurrence of peeling-off and abrasion were observed on the surface of the particles.

Comparative Example 5

A 1-L four-necked flask was charged with 15 parts by weight of phenol, 18 parts by weight of 37% formalin, 100 parts by weight of the spherical magnetite particles A subjected to lipophilic treatment, 7 parts by weight of 25% aqueous ammonia and 19 parts by weight of water, and the contents of the flask were heated to 85° C. over 60 min while stirring at a stirring speed of 250 rpm. Then, the contents of the flask were reacted and cured at the same temperature for 120 min, thereby producing spherical composite core particles comprising the ferromagnetic iron oxide fine particles and the binder resin.

Next, while stirring the contents of the flask at a stirring speed of 250 rpm, 2.2 parts by weight of water, 0.6 part by weight of ammonium chloride, 0.6 part by weight of a melamine powder and 1.5 parts by weight of 37% formalin were added to the flask, and the contents of the flask were reacted and cured for 120 min, thereby producing spherical composite particles provided on the surface thereof with a melamine resin coating layer.

Next, the contents of the flask were cooled to 30° C., and then a supernatant liquid was removed therefrom. Further, the resulting precipitate as a lower layer was washed with water and then air-dried. Next, the dried precipitate was dried at a temperature of 150 to 180° C. under reduced pressure (not more than 5 mmHg) to obtain spherical composite particles.

As a result, it was confirmed that the resulting spherical composite particles had an average particle diameter of 56 μm; a bulk density of 1.93 g/cm$^3$; a specific gravity of 3.63 g/cm$^3$; a saturation magnetization value of 73.4 Am$^2$/kg; an electric resistance value $R_{100}$ of $2.5\times10^{13}$ Ω·cm as measured when applying a voltage of 100 V thereto; an electric resistance value $R_{300}$ of $1.4\times10^{10}$ Ω·cm as measured when applying a voltage of 300 V thereto; and a ratio of $R_{100}/R_{300}$ of 1720.

As a result, it was confirmed that the resulting spherical composite particles had a particle shape close to a sphere, but a non-uniform melamine resin coating layer to which the underlying ferromagnetic iron oxide fine particles were exposed was formed on the surface of the respective spherical composite particles.

Various properties of the obtained spherical composite particles as well as the results of forced deterioration test thereof are shown in Table 2.

Thus, it was confirmed that when subjected to forced deterioration test, the rates of change in charge amount and electric resistance value of the spherical composite particles obtained in Comparative Example 5 were large, and occurrence of peeling-off and abrasion were observed on the surface of the particles.

TABLE 1

| Examples and Comp. Examples | Composite core particles | | | | |
|---|---|---|---|---|---|
| | Ferromagnetic iron oxide particles | | Phenol | Aldehyde compound | |
| | Kind | Amount (wt part) | Amount (wt part) | Kind | Amount (wt part) |
| Example 1 | A | 100 | 12 | 37% Formalin | 15 |
| Example 2 | A | 100 | 13 | 37% Formalin | 15 |
| Example 3 | A | 100 | 11 | 37% Formalin | 14 |
| Example 4 | A | 100 | 12 | 37% Formalin | 16 |
| Example 5 | B | 100 | 11 | 37% Formalin | 14 |

TABLE 1-continued

| | | | | | |
|---|---|---|---|---|---|
| Comp. Example 1 | A | 100 | 13 | 37% Formalin | 15 |
| Comp. Example 2 | A | 100 | 12 | 37% Formalin | 14 |

| Examples and Comp. Examples | Composite core particles: Basic catalyst Kind | Basic catalyst Amount (wt part) | Water Amount (wt part) |
|---|---|---|---|
| Example 1 | 25% Aqueous ammonia | 7 | 12 |
| Example 2 | 25% Aqueous ammonia | 6 | 13 |
| Example 3 | 25% Aqueous ammonia | 6 | 12 |
| Example 4 | 25% Aqueous ammonia | 6 | 16 |
| Example 5 | 25% Aqueous ammonia | 6 | 18 |
| Comp. Example 1 | 25% Aqueous ammonia | 5 | 16 |
| Comp. Example 2 | 25% Aqueous ammonia | 4 | 10 |

| Examples and Comp. Examples | Composite particles Acid catalyst: Acid Kind | Acid Amount (wt part) | Water Amount (wt part) |
|---|---|---|---|
| Example 1 | 99% acetic acid | 0.50 | 0.3 |
| Example 2 | 99% acetic acid | 0.50 | 0.3 |
| Example 3 | 99% acetic acid | 0.50 | 0.3 |
| Example 4 | 99% acetic acid | 0.65 | 0.4 |
| Example 5 | 99% acetic acid | 0.65 | 0.4 |
| Comp. Example 1 | 99% acetic acid | 0.50 | 0.3 |
| Comp. Example 2 | 99% acetic acid | 0.50 | 0.3 |

| Examples and Comp. Examples | Composite particles Melamine solution: Melamine Amount (wt part) | Aldehyde compound Kind | Aldehyde compound Amount (wt part) | Water Amount (wt part) |
|---|---|---|---|---|
| Example 1 | 0.5 | 37% Formalin | 1.3 | 1.5 |
| Example 2 | 0.6 | 37% Formalin | 1.5 | 1.8 |
| Example 3 | 0.7 | 37% Formalin | 1.8 | 2.1 |
| Example 4 | 0.5 | 37% Formalin | 1.3 | 1.5 |
| Example 5 | 0.6 | 37% Formalin | 1.6 | 1.8 |
| Comp. Example 1 | 1.2 | 37% Formalin | 3.1 | 3.5 |
| Comp. Example 2 | 0.2 | 37% Formalin | 0.5 | 0.6 |

| Examples and Comp. Examples | Composite particles: Temperature ° C. | Time min |
|---|---|---|
| Example 1 | 85 | 120 |
| Example 2 | 85 | 120 |
| Example 3 | 85 | 120 |
| Example 4 | 80 | 90 |
| Example 5 | 85 | 80 |
| Comp. Example 1 | 85 | 120 |
| Comp. Example 2 | 85 | 120 |

TABLE 2

| Examples and Comp. Examples | Properties of composite particles: Average particle diameter (μm) | Shape factor SF1 | Shape factor SF2 | Bulk density (g/cm³) |
|---|---|---|---|---|
| Example 1 | 36 | 103 | 104 | 1.94 |
| Example 2 | 36 | 105 | 104 | 1.93 |
| Example 3 | 38 | 105 | 107 | 1.94 |
| Example 4 | 35 | 104 | 107 | 1.88 |
| Example 5 | 36 | 104 | 106 | 1.89 |
| Comp. Example 1 | 38 | 102 | 104 | 1.92 |
| Comp. Example 2 | 34 | 103 | 105 | 1.95 |
| Comp. Example 3 | 48 | 103 | 106 | 1.91 |
| Comp. Example 4 | 47 | 104 | 107 | 1.91 |
| Comp. Example 5 | 56 | 104 | 106 | 1.93 |

| Examples and Comp. Examples | Properties of composite particles: Specific gravity (g/cm³) | Saturation magnetization (Am²/kg) | Residual magnetization (Am²/kg) | Content of magnetic particles (%) |
|---|---|---|---|---|
| Example 1 | 3.60 | 73.5 | 4.7 | 87 |
| Example 2 | 3.53 | 74.8 | 4.9 | 86 |
| Example 3 | 3.43 | 72.6 | 5.1 | 85 |
| Example 4 | 3.60 | 71.4 | 5.3 | 87 |
| Example 5 | 3.65 | 77.6 | 4.8 | 87 |
| Comp. Example 1 | 3.48 | 72.6 | 5.0 | 85 |
| Comp. Example 2 | 3.59 | 73.6 | 5.1 | 87 |
| Comp. Example 3 | 3.58 | 73.7 | 5.4 | 86 |
| Comp. Example 4 | 3.55 | 73.5 | 5.2 | 86 |
| Comp. Example 5 | 3.63 | 73.4 | 5.6 | 87 |

| Examples and Comp. Examples | Properties of composite particles Electric resistance: Applied voltage (Ω · cm) 100 V | 300 V | $R_{100}/R_{300}$ |
|---|---|---|---|
| Example 1 | 1.4E+10 | 2.5E+09 | 6 |
| Example 2 | 6.9E+10 | 6.2E+09 | 11 |
| Example 3 | 1.5E+11 | 6.6E+09 | 23 |
| Example 4 | 4.3E+10 | 4.8E+09 | 9 |
| Example 5 | 2.6E+10 | 3.5E+09 | 7 |
| Comp. Example 1 | 2.2E+13 | 1.3E+11 | 169 |
| Comp. Example 2 | 8.2E+08 | * | — |
| Comp. Example 3 | 3.0E+08 | * | — |
| Comp. Example 4 | 7.1E+12 | 5.5E+10 | 130 |
| Comp. Example 5 | 2.5E+13 | 1.4E+10 | 1720 |

| Examples and Comp. Examples | Properties of composite particles: Melamine content (%) | Water content (%) | Forced deterioration test: Rate of change in charge amount | Rate of change in resistance |
|---|---|---|---|---|
| Example 1 | 0.17 | 0.52 | A | A |
| Example 2 | 0.22 | 0.54 | B | A |

TABLE 2-continued

| | | | | |
|---|---|---|---|---|
| Example 3 | 0.31 | 0.56 | A | A |
| Example 4 | 0.19 | 0.54 | A | A |
| Example 5 | 0.27 | 0.47 | B | B |
| Comp. Example 1 | 0.65 | 0.61 | A | A |
| Comp. Example 2 | 0.04 | 0.47 | D | D |
| Comp. Example 3 | — | 0.55 | D | A |
| Comp. Example 4 | 0.20 | 0.63 | D | D |
| Comp. Example 5 | 0.25 | 0.64 | D | E |

Note

* Not measurable owing to excessively low electric resistance.

Production of Resin-Coated Carrier

Example 6

Under a nitrogen flow, a Henschel mixer was charged with 1 kg of the spherical composite particles 1, 10 g (as a solid content) of a silicone-based resin (tradename "KR251" produced by Shin-Etsu Chemical Co., Ltd.) and 1.5 g of carbon black (tradename "TOKABLACK #4400" produced by Tokai Carbon Co., Ltd.), and the contents of the Henschel mixer were stirred at a temperature of 50 to 150° C. for 1 hr, thereby forming a resin coating layer formed of the silicone-based resin comprising carbon black on the surface of the respective particles.

The thus obtained resin-coated magnetic carrier had an average particle diameter of 36 μm, a bulk density of 1.85 g/cm$^3$, a specific gravity of 3.55 g/cm$^3$, a saturation magnetization value of 72.4 Am$^2$/kg, and an electric resistance value of $7.9\times10^{12}$ Ω·m as measured upon applying a voltage of 100 V thereto.

The silicone-based resin coating layer of the thus obtained resin-coated magnetic carrier was observed using a scanning electron microscope ("S-4800" manufactured by Hitachi Ltd.). As a result, it was confirmed that the resin coating layer was uniformly and sufficiently formed.

Examples 7 to 10 and Comparative Examples 6 to 10

The same procedure as defined in Example 6 was conducted under the same conditions except that the kind of spherical composite particles and the kind of coating resin were variously changed, thereby obtaining resin-coated magnetic carriers.

The production conditions and various properties of the thus obtained resin-coated magnetic carriers are shown in Table 3.

The resin coating layers of the thus obtained resin-coated magnetic carriers obtained in Examples 7 to 10 and Comparative Examples 6 to 10 were observed using a scanning electron microscope ("S-4800" manufactured by Hitachi Ltd.). As a result, it was confirmed that the resin coating layers were uniformly and sufficiently formed.

TABLE 3

| Examples and Comp. Examples | Kind of composite particles | Composition of magnetic carrier: Coating resin: Kind | Coating resin: Ratio to core material (%) | Additives: Kind | Additives: Ratio to resin (%) |
|---|---|---|---|---|---|
| Example 6 | Example 1 | Silicone-based resin | 1.0 | Carbon black | 15 |
| Example 7 | Example 2 | Silicone-based resin | 1.0 | Carbon black | 15 |
| Example 8 | Example 3 | Silicone-based resin | 1.0 | Carbon black | 15 |
| Example 9 | Example 4 | Silicone-based resin | 1.0 | Carbon black | 15 |
| Example 10 | Example 5 | Acrylic resin | 1.0 | Carbon black | 15 |
| Comp. Example 6 | Comp. Example 1 | Silicone-based resin | 1.0 | Carbon black | 15 |
| Comp. Example 7 | Comp. Example 2 | Silicone-based resin | 1.0 | Carbon black | 15 |
| Comp. Example 8 | Comp. Example 3 | Silicone-based resin | 1.0 | Carbon black | 15 |
| Comp. Example 9 | Comp. Example 4 | Silicone-based resin | 1.0 | Carbon black | 15 |
| Comp. Example 10 | Comp. Example 5 | Silicone-based resin | 1.0 | Carbon black | 15 |

| Examples and Comp. Examples | Properties of magnetic carrier: Average particle diameter (μm) | Shape factor: SF1 | Shape factor: SF2 | Bulk density (g/cm$^3$) |
|---|---|---|---|---|
| Example 6 | 36 | 102 | 104 | 1.85 |
| Example 7 | 37 | 105 | 105 | 1.89 |
| Example 8 | 38 | 104 | 107 | 1.93 |
| Example 9 | 36 | 103 | 107 | 1.84 |
| Example 10 | 37 | 104 | 105 | 1.84 |
| Comp. Example 6 | 38 | 103 | 105 | 1.86 |
| Comp. Example 7 | 35 | 104 | 105 | 1.91 |
| Comp. Example 8 | 48 | 103 | 104 | 1.88 |
| Comp. Example 9 | 37 | 105 | 106 | 1.85 |
| Comp. Example 10 | 55 | 104 | 106 | 1.84 |

| Examples and Comp. Examples | Properties of magnetic carrier: Specific gravity (g/cm$^3$) | Saturation magnetization (Am$^2$/kg) | Electric resistance (Ω · cm) 100 V | Water content (%) |
|---|---|---|---|---|
| Example 6 | 3.55 | 72.4 | 7.9E+12 | 0.57 |
| Example 7 | 3.50 | 73.3 | 2.3E+13 | 0.57 |
| Example 8 | 3.43 | 72.1 | 5.8E+13 | 0.60 |
| Example 9 | 3.51 | 71.0 | 9.0E+12 | 0.56 |
| Example 10 | 3.57 | 76.2 | 6.7E+12 | 0.52 |
| Comp. Example 6 | 3.46 | 72.1 | 2.5E+15 | 0.63 |
| Comp. Example 7 | 3.55 | 73.1 | 3.4E+13 | 0.50 |
| Comp. Example 8 | 3.55 | 72.4 | 5.6E+12 | 0.65 |
| Comp. Example 9 | 3.51 | 73.0 | 1.4E+13 | 0.65 |

TABLE 3-continued

| | | | | |
|---|---|---|---|---|
| Comp. Example 10 | 3.58 | 73.0 | 3.9E+16 | 0.68 |

The evaluation results of printing durability of the magnetic carriers obtained in Examples 1 and 6 to 10 and Comparative Examples 1, 2 and 6 to 10 are shown in Table 4.

TABLE 4

| Kind of carrier | Evaluation of printing durability Image density | | | |
|---|---|---|---|---|
| | Initial | | After printing 1,000,000 sheets | |
| | NN | HH | NN | HH |
| Example 1 | A | B | A | B |
| Example 6 | A | B | A | B |
| Example 7 | A | A | A | A |
| Example 8 | A | A | A | A |
| Example 9 | A | A | A | A |
| Example 10 | A | A | A | A |
| Comp. Example 1 | B | A | C | C |
| Comp. Example 2 | B | C | C | E |
| Comp. Example 6 | B | A | C | C |
| Comp. Example 7 | B | C | C | E |
| Comp. Example 8 | C | D | D | E |
| Comp. Example 9 | A | A | B | C |
| Comp. Example 10 | A | B | B | D |

| Kind of carrier | Evaluation of printing durability Fogging | | | |
|---|---|---|---|---|
| | Initial | | After printing 1,000,000 sheets | |
| | NN | HH | NN | HH |
| Example 1 | A | B | B | B |
| Example 6 | A | B | B | B |
| Example 7 | A | A | A | B |
| Example 8 | A | A | A | A |
| Example 9 | A | B | A | B |
| Example 10 | A | A | A | B |
| Comp. Example 1 | A | A | B | B |
| Comp. Example 2 | B | C | D | D |
| Comp. Example 6 | A | A | B | B |
| Comp. Example 7 | B | C | D | D |
| Comp. Example 8 | C | C | D | D |
| Comp. Example 9 | A | B | C | D |
| Comp. Example 10 | A | A | C | D |

| Kind of carrier | Evaluation of printing durability Gradation | | | |
|---|---|---|---|---|
| | Initial | | After printing 1,000,000 sheets | |
| | NN | HH | NN | HH |
| Example 1 | A | A | A | A |
| Example 6 | A | A | A | A |
| Example 7 | A | A | A | B |
| Example 8 | A | A | B | B |
| Example 9 | A | A | A | A |
| Example 10 | A | A | A | A |
| Comp. Example 1 | D | D | E | E |
| Comp. Example 2 | E | E | E | E |
| Comp. Example 6 | D | D | E | E |
| Comp. Example 7 | E | E | E | E |
| Comp. Example 8 | E | E | E | E |
| Comp. Example 9 | D | D | E | E |
| Comp. Example 10 | E | E | E | E |

From the above evaluation results of printing durability, it was confirmed that under any environmental conditions, the magnetic carrier and the developer according to the present invention are capable of maintaining an adequate electric resistance value, exhibiting an excellent image quality and a high durability, obtaining a good reproducibility of uniform solid image portions having a high image density, and keeping high-quality images having an excellent gradation for a long period of time.

INDUSTRIAL APPLICABILITY

In the magnetic carrier according to Invention 1, since the thin uniform melamine resin coating layer is formed on the surface of the respective spherical composite core particles, it is possible to reduce a voltage dependency of the electric resistance value of the magnetic carrier comprising the spherical composite particles. Therefore, the magnetic carrier according to Invention 1 can be suitably used as a magnetic carrier for an electrophotographic developer.

In the magnetic carrier according to Invention 2, since the thin uniform melamine resin coating layer is formed on the surface of the respective spherical composite core particles, it is possible to reduce a voltage dependency of the electric resistance value of the magnetic carrier comprising the spherical composite particles, and adequately control the electric resistance value. Therefore, the magnetic carrier according to Invention 2 can be suitably used as a magnetic carrier for an electrophotographic developer.

In the magnetic carrier according to Invention 3 which is obtained by coating the surface of the respective spherical composite particles with a resin, since the thin uniform melamine resin coating layer is formed on the surface of the respective particles, it is possible to reduce a voltage dependency of the electric resistance value of the spherical composite particles, and adequately control the electric resistance value, so that the electric resistance characteristics and charging characteristics of the magnetic carrier obtained by forming the coating resin layer on the surface of the respective spherical composite particles can be readily designed. Therefore, the resin-coated magnetic carrier according to Invention 3 can be suitably used as a magnetic carrier for an electrophotographic developer.

The two-component system developer according to Invention 4 is capable of maintaining a high-quality image which is excellent in image density, gradation, etc. In particular, in a high-voltage range in which an electric resistance of a core material of the carrier tends to be adversely affected, the developer is free from occurrence of brush marks on a solid image portion owing to leakage of electric charges and formation of defective images such as those having deteriorated gradation. Further, it is possible to prevent the magnetic carrier from suffering from deterioration with time owing to abrasion or peeling-off of the coating resin therefrom when used for a long period of time. Therefore, the two-component system developer according to Invention 4 can be suitably used as an electrophotographic developer comprising a magnetic carrier for an electrophotographic developer and a toner.

In the process for producing the magnetic carrier for a two-component system developer according to Invention 5, an acidic aqueous solution comprising an acid having an acid dissociation constant pKa of 3 to 6 as an acid catalyst and a methylol melamine aqueous solution are added to an aqueous medium comprising spherical composite core particles comprising ferromagnetic iron oxide fine particles and a cured phenol resin to thereby form a melamine resin coating layer on the surface of the respective spherical composite particles. As a result, it is possible to reduce a voltage dependency of the electric resistance value of the magnetic carrier comprising the spherical composite particles. Therefore, the production process according to Invention 5 is suitable as a process for producing a magnetic carrier for an electrophotographic developer.

The invention claimed is:

1. A magnetic carrier for an electrophotographic developer comprising spherical composite particles comprising:

spherical composite core particles which comprises at least ferromagnetic iron oxide fine particles and a cured phenol resin, and which have an average particle diameter of 1 to 100 μm, and a coating layer consisting of melamine resin formed on the respective core particles, which magnetic carrier for an electrophotographic developer has a ratio of $R_{100}$ to $R_{300}$ ($R_{100}/R_{300}$) within the range of 1 to 50, where $R_{100}$ is an electric resistance value as measured when applying a voltage of 100 V to the magnetic carrier, and $R_{300}$ is an electric resistance value as measured when applying a voltage of 300 V to the magnetic carrier.

2. A magnetic carrier for an electrophotographic developer according to claim 1, wherein the electric resistance value as measured when applying a voltage of 100 V to the magnetic carrier is $1.0\times10^{6}$ Ωcm to $1.0\times10^{16}$ Ωm.

3. A magnetic carrier for an electrophotographic developer according to claim 1, a further coating layer comprising at least one resin selected from the group consisting of a silicone-based resin, a fluororesin, an acrylic resin and a styrene-acrylic resin, on a surface of the respective spherical composite particles.

4. A two-component system developer comprising the magnetic carrier for an electrophotographic developer as defined in claim 1 and a toner.

5. A process for producing the magnetic carrier for an electrophotographic developer as defined in claim 1, comprising the steps of:

reacting at least ferromagnetic iron oxide fine particles, a phenol compound and an aldehyde compound in an aqueous medium in the presence of a basic catalyst to produce spherical composite core particles comprising the ferromagnetic iron oxide fine particles and the cured phenol resin; and then adding an acid aqueous solution having an acid dissociation constant pKa of 3 to 6 as an acid catalyst and a methylol melamine aqueous solution to the aqueous medium comprising the resulting spherical composite core particles to form a melamine resin coating layer on a surface of the respective spherical composite core particles.

* * * * *